United States Patent [19]

Luenser

[11] Patent Number: 4,747,502

[45] Date of Patent: May 31, 1988

[54] VENTED BEVERAGE CLOSURE

[75] Inventor: Werner R. Luenser, Blue Island, Ill.

[73] Assignee: Ethyl Molded Products Company, Richmond, Va.

[21] Appl. No.: 98,084

[22] Filed: Sep. 23, 1987

Related U.S. Application Data

[63] Continuation-in-part of Ser. No. 916,236, Oct. 10, 1986, abandoned.

[51] Int. Cl.[4] ..... B65D 51/16

[52] U.S. Cl. ..... 215/307; 220/366

[58] Field of Search ..... 215/307; 220/366, 367

[56] References Cited

U.S. PATENT DOCUMENTS 4,007,848 2/1976 Snyder ..... 215/307 X 4,427,126 1/1984 Ostrowsky ..... 215/307

*Primary Examiner*—Donald F. Norton

*Attorney, Agent, or Firm*—P. M. Pippenger; J. Bradley Overton

[57] ABSTRACT

A threaded thermoplastic closure suitable for fitment to a threaded container neck is disclosed. The closure is provided with one or more vent grooves cut through the primary threads in the inner wall of the closure skirt. The ends of each thread segment are rounded and a smaller reinforcing secondary thread within the groove extends across the groove connecting the thread segments. The lower edge portion of the secondary thread is aligned with the lower edge portion of the adjacent segments of the primary thread to maximize the venting space over the secondary thread.

15 Claims, 2 Drawing Sheets

VENTED BEVERAGE CLOSURE

REFERENCE TO RELATED APPLICATION

This is a continuation-in-part of prior copending application Ser. No. 916,236 filed Oct. 10, 1986, now abandoned.

BACKGROUND OF THE INVENTION

The present invention is in the general area of threaded closures and particularly relates to such closures for threaded containers for carbonated beverages.

The utilization of threaded closures for use in packaging of carbonated beverages has become very popular. The popularity is due in part to the fact that the consumer can open the package by merely unscrewing the closure from the container. No "bottle opening" tool is required. Another advantage is that the consumer is able to remove the closure, dispense part of the contents from the container and reclose the container by merely screwing the closure back thereon. Since the sealing system is generally of high fidelity, there will be little loss of carbonation and the remaining packaged product will be suitable for use at a later time.

Despite these advantages, the threaded container-closure package has potentially a serious problem, i.e., premature release of the closure from the container which can occur with great force. The premature release occurs as the user turns the closure to remove it from the container. As the closure is turned, it moves axially upwardly thus breaking the seal between the top of the closure and the top of the container. Upon loss of the seal, pressurized gas enters between the sidewall of the closure and the container. If the closure is removed faster than the gas is being vented from the container, at the time the closure disengages from the container thread the container closure may be propelled off with great force, thereby presenting danger to the consumer.

One of the most popular threaded closures used in packaging carbonated products is the nearly ubiquitous metal cap. To aid in preventing premature release of this type of closure the art has suggested providing a vent slot through the container threads. The slot provides a path for the pressurized gas to vent to the atmosphere. See U.S. Pat. No. 4,007,848. In U.S. Pat. No. 4,007,851, another venting method for metal closures is shown. The closure is constructed to have, at a point adjacent the intersection of the sidewall and the top wall, at least one vent through which the pressurized gas may pass. Another type of system, one which uses circumferential venting, is shown in U.S. Pat. No. 1,739,659.

In the case of thermoplastic closures, attention has also been devoted to the provision of venting grooves or systems of various configurations in order to release the pressurized gas during the time the closure is being removed from the container. Some of the developments along these lines are described for example in U.S. Pat. Nos. 3,888,347, 4,382,521, and 4,427,126.

In accordance with this invention, a new venting system for thermoplastic closures is provided. This venting system enables a relatively large volume of pressurized gas to be rapidly but safely vented as the closure is being unscrewed from the container but before the closure is disengaged from the container threads.

OBJECTS OF THE INVENTION

Accordingly, a primary object of the present invention is to provide a vented beverage closure for bottles in which a relatively large volume of carbon dioxide can be rapidly but safely vented during the time the closure is being removed from the bottle.

Another object of the invention is to decrease closure thread pull at the vent blade causing less thread distortion and vent blockage.

Still another object of the invention is to reduce tool cost of the core in the forming of the thread and vents.

Yet another object of the invention is to provide a closure which can be removed from a pressured threaded container without danger of missiling occurring.

Other objects and advantages of the invention will become more readily apparent from a reading of the drawings and the specification hereinafter.

SUMMARY OF THE INVENTION

The present invention is a vented, threaded thermoplastic closure for threaded container necks. The closure or bottle cap has one or more vent grooves cut through the primary threads in the inner wall of the closure skirt. The ends of each thread segment are rounded and a smaller reinforcing secondary thread within the groove extends across the groove connecting the lower portions of the thread segments. This reinforcing thread is not only smaller in cross-section than the adjacent primary thread segments but it is disposed in the groove in a position where its lower edge ("lower" being used to denote the edge of thread that is closer to the bottom of the container to which the closure is attached) is aligned with (is in the same plane as) the lower edge of each of the two adjacent primary thread segments. This maximizes the size of the venting space through which the pressurized gas can escape as the closure is being unscrewed from the threaded container. This in turn allows the internal pressure of the container to be released rapidly during the time the threads of the closure remain engaged with the threads of the container. Accordingly, once the closure has been rotated to the point where it becomes disengaged from the container, the internal pressure within the container has been sufficiently relieved so that missiling of the closure does not occur.

The container-closure package is highly suitable for use in packaging products such as carbonated beverages, which develop internal package pressure. The thermoplastic closure has a top wall with an annular sidewall depending downwardly therefrom. About the inside surface of the annular sidewall a closure thread is provided for cooperation with the container neck thread. A sealing system is also provided above the closure thread for effecting a gas-tight seal between the closure and the container. The sealing system can be either a linerless system or a system which utilizes a liner. Such systems are well-known to those skilled in the art and the only requirement for use of a sealing system with the closure of this invention is that it be capable of holding expected internal package pressures. To provide relief of internal package pressures as the closure of this invention is unscrewed from the container, the closure features at least one venting groove in the closure sidewall which traverses the closure thread. The vents of the closure are uniform and recessed. Rigidifying structure (i.e., a secondary thread) is also provided to enhance the hoop strength of the closure sidewall at the venting groove(s). The structure is located at each point of traverse by the venting groove with the closure thread. In other words, the secondary thread traverses each venting groove. The rigidifying structure (secondary thread) is dimensioned so that its perpendicular height, measured from the sidewall, is less than the perpendicular height of the closure thread also measured from the inside surface of the sidewall. By having the rigidifying structure with this smaller dimension, the pressurized gas is able to find sufficient escapement cross sectional area in the venting groove. Location of the rigidifying structure at the point(s) of intersection of the vent groove and the closure thread insures that no threading interference will occur between the structure and the cooperation of the closure and container threads. And, as noted above, the lower edge of this smaller secondary thread is aligned with the lower edges of the adjacent primary threads thereby maximizing the size of the vent opening through which the pressurized gas flows when the closure is being removed from its container.

The vented beverage closure of this invention wherein an interrupted vent forming thread is employed has a number of advantages as follows:

(1) The interrupted thread increases the recessed area for venting of the closure.

(2) The bottom plane of the primary thread and the bottom plane of the secondary thread are on the same plane, and create a smooth void to allow carbon dioxide gas to escape at a greater rate than would be possible by positioning the secondary thread medially with respect to the primary threads in the manner depicted in U.S. Pat. No. 4,427,126.

(3) The smooth voided area of the thread also negates the interference with the sharp vent grooves of the neck finish of PET (polyethylene terephthalate) bottles and the like.

These and other features of this invention contributing to satisfaction in use and economy in manufacture will be more fully understood when taken in connection with the following description of preferred embodiments and the accompanying drawings in which identical numerals refer to identical parts.

DESCRIPTION OF PREFERRED EMBODIMENTS

Figure 1:
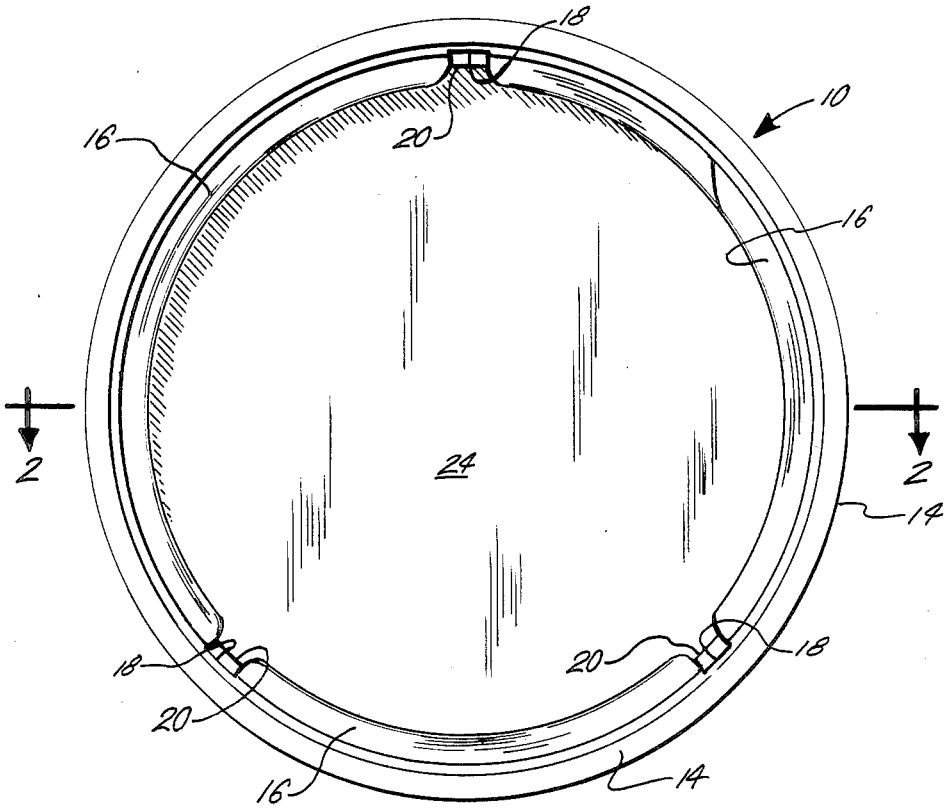
FIG. 1 is a plan view of the closure of this invention as viewed from the bottom to the top.

Referring now to FIGS. 1–4, it can be seen that a closure of this invention, generally designated by the numeral 10, has a top wall 12 and an annular downwardly depending sidewall 14. About the inside surface of sidewall 14 is provided a helical closure thread 16. Closure thread 16 is dimensioned for cooperation with container thread 42, shown in FIGS. 3 and 4, to achieve fitment of closure 10 to container neck 40.

Figure 2:
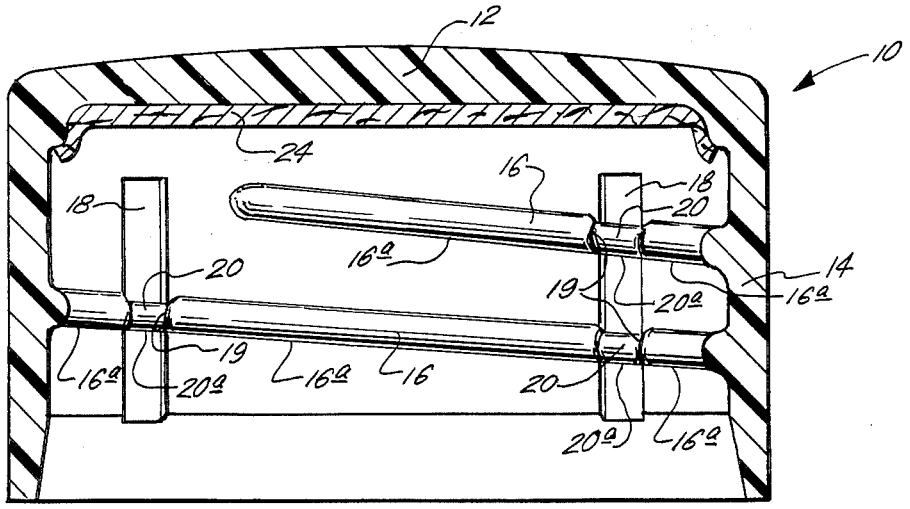
FIG. 2 is a sectional view taken through section line 2—2 in FIG. 1.
Figure 4:
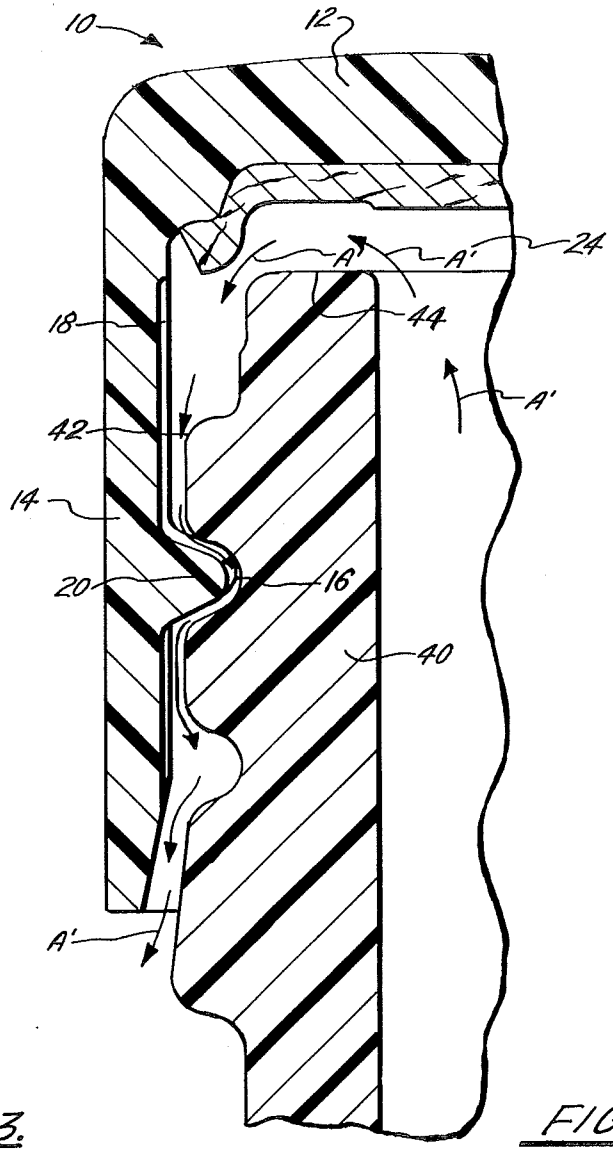
FIG. 4 is an enlarged partial sectional view showing the path of escapement for the pressurized gas as the closure shown in FIGS. 1 and 2 is removed from a container.
Figure 3:
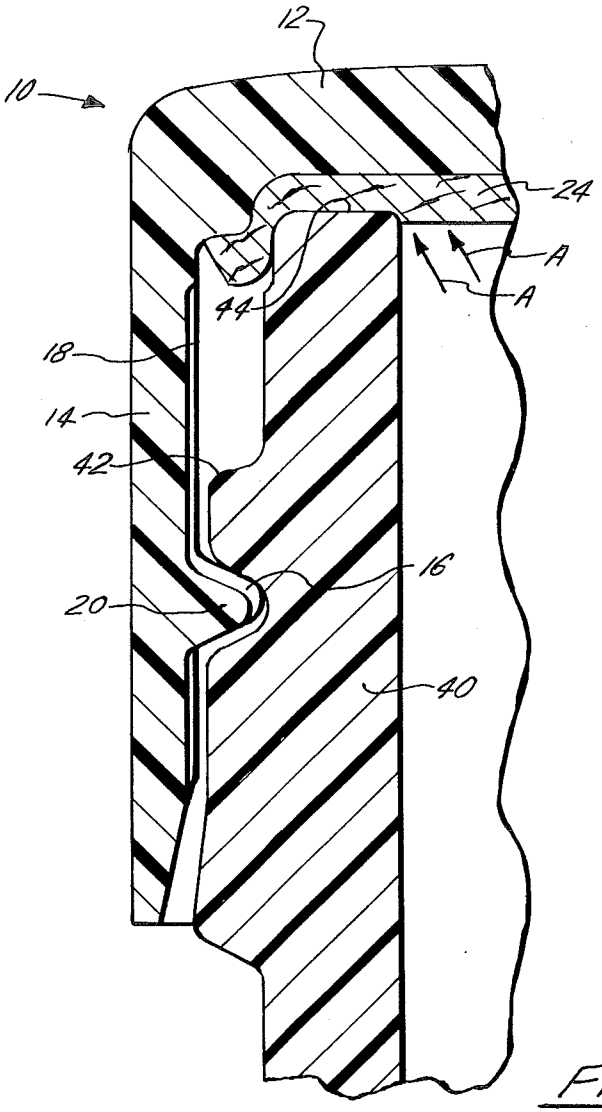
FIG. 3 is an enlarged partial sectional view showing the closure of FIGS. 1 and 2 torqued on the container neck finish of a pressurized container.

Extending from a point above closure thread 16 to a point below closure thread 16 is venting groove 18. As is shown in FIGS. 3 and 4, venting groove 18 is on the inside surface of sidewall 14. As best seen in FIG. 2, venting groove 18 interrupts thread 16 and divides it into individual helically aligned segments. The venting groove 18 has a depth such that it is recessed into the inside surface of sidewall 14. The width of venting groove 18, coupled with the number of venting grooves used, is such that sufficient venting groove cross-sectional area is provided for venting of the pressurized gas at a rate so that conventional removal of closure 10 from the container will occur only after the venting is substantially accomplished.

Preferably closure 10 has a plurality of venting grooves 18 and is fabricated from a tough thermoplastic such as polypropylene, polyethylene or nylon. When used for capping soft drink bottles, the closure of this invention allows an increase in the rate and more uniform venting of carbon dioxide gas during removal of the closure from the pressurized container. The vents of the closure are uniform and recessed, and do not interfere with the container neck finish during the application of the closure.

Traversing venting groove 18 at each point of its intersection with (i.e., interruption of) closure thread 16 is rigidifying structure 20. For the embodiment shown in FIGS. 2, 3 and 4, rigidifying structure 20 has a generally semielliptical cross-sectional shape. Whatever the form of rigidifying structure 20, it cannot have a height, measured from the inside surface of sidewall 14, equal to or greater than the height of closure thread 16, also measured from the inside surface of sidewall 14. However, the height of rigidifying structure 20 should not be so small that it is not able to achieve its required enhancement of sidewall hoop strength. Determination of the height of rigidifying structure 20 will be dependent on several factors, i.e., the pressures expected to be encountered, the material of construction for the closure, the volume of the container used, the width and depth venting groove(s) 18, the length of closure thread 16 and the degree of engagement between closure thread 16 and container thread 42.

The end portions 19 of each segment of thread 16 are rounded. This precludes or at least greatly reduces the likelihood of hang-up and thread distortion as the closure is applied to or removed from the container.

In order to maximize the size of the venting space through which the pressurized gas within the container may flow while closure 10 is being unscrewed from container neck 40, the lower edge or plane **20*a* of rigidifying structure 20 is aligned with the lower edge or plane 16*a* of closure thread 16 (note FIG. 2). Since rigidifying structure 20 has a smaller cross-sectional area than closure thread 16 (note FIGS. 2 and 3), at least the median edge or surface of rigidifying structure 20 is offset from the corresponding edges or surfaces of closure thread 16 thereby providing the enlarged venting passage through which the pressurized gas may flow, as depicted in FIG. 4. Most preferably, the height and width of structure 20 are both less than the height and width of thread 16 so that the median and upper edges or surfaces of structure 20 are all offset from the corresponding edges or surfaces of thread 16**.

In FIG. 3, wherein the closure 10 is torqued on the container neck 40, it is seen that the top portion 44 of neck 40 is seated against closure liner 24. Arrows "A" show carbon dioxide gas exerting force against the closure liner 24.

In FIG. 4, the closure 10 is shown in an opening position wherein the top portion of 44 neck 40 has been moved away from the closure liner 24 thereby allowing the carbon dioxide gas to escape through the venting area along groove(s) 18 and over the rigidifying structure(s) 20 traversing groove(s) 18. Arrows A' show the path of the escaping gas. FIG. 4 also illustrates the fact that during this venting operation closure thread 16 remains engaged with container thread 42 thereby preventing closure 10 from being missiled or forced away from the container while this internal pressure is being released.

In FIG. 1, three vent areas are shown, but as few as one is suitable and four or more are desirable. As venting occurs, carbon dioxide pressure on the inside of the closure liner 24 keeps the top of the closure thread 16 in contact with the bottom of the neck finish thread 42. The venting grooves 18 of the closure 10 form the voids for the vent. The radius of the start and finish of the thread 16 should be as small as possible, 3/16 of an inch or less to maximize the degree length of full thread depth. The rigidifying structure or secondary thread 20 is cut through the intersecting areas, and is in line with the bottom of the interrupted primary thread 16 to increase the hoop strength of the closure and provide a maximum venting area.

In FIGS. 3 and 4 the venting of pressurized gas from the package is shown. Note that as closure 10 is rotated about container neck 40, closure 10 moves axially upward. This axial upward movement results in liner 24 being removed from its nesting position on the top 44 of container neck 40. Pressurized gas in the interior of the container begins movement through groove 18 as indicated by the arrows. As can be seen, the utilization of rigidifying structure 20 does not interfere with passage of the pressurized gas while at the same time the aforementioned enhancement in hoop strength provided by rigidifying structure 20 is realized. As closure 10 continues its removal rotation, pressurized gas is continuously vented until the interior package pressure is equal to ambient pressure. Since there has been no loss of container thread to closure thread cooperation, removal of closure 10 is done without fear of premature closure release.

An example of a useful closure is one made of polypropylene having a vent groove width of about 1/16" and depth of about 0.005/0.015", a sidewall thickness of 0.035/0.055", a closure thread traversing approximately 480 degrees having conventional thread engagement and rigidifying structure height of about $\frac{2}{3}$ of thread height. Closures as described in the immediately preceding sentence having a sidewall thickness in the range of 0.035" to 0.045" have proven satisfactory for particular applications. For other materials and other venting channel depths and sidewall thicknesses, the sizing of rigidifying structure 20 is empirically determined by observation and experimentation, both of which are well within the ability of those skilled in the art having the disclosure of this invention before them.

For the embodiment shown, the sealing system uses a liner. The liner 24 nests against the inside surface of top wall 12. Retaining beads may be utilized to maintain liner 24 in adjacent position to the inside surface of top wall 12 when closure 10 is not fitted to the container. It will be understood of course that the sealing system can be either with a liner or without a liner and can be of any configuration so long as it is capable of maintaining a gas-tight seal under the conditions and internal pressures anticipated by the packager.

The closures of the invention can be made by any conventional injection molding technique. The thermoplastic materials which may be utilized for producing this closure are those which are conventionally utilized in closure manufacture. For example, the closure may be made from high density polyethylene, polypropylene, nylon, or the like. Any other suitable thermoplastic materials may be used.

Closures of the type of this invention are frequently of the tamperproof closure type. Types of tamperproof systems for use on thermoplastic closures are illustrated in U.S. Pat. Nos. 4,206,851 and 4,369,889. The systems utilize a fracturable band attached to the lowermost end of the closure sidewall by a plurality of non-fracturable ribs. For simplicity of illustration, such fracturable band is not shown in the drawings. The tamperproof construction of the aforesaid patents is specifically incorporated herein.

The foregoing disclosure and description of the invention is illustrative and explanatory thereof and various changes in the illustrated construction may be made within the scope of the appended claims without departing from the spirit of the invention.

What is claimed is:

1. A thermoplastic closure suitable for fitment to a threaded container neck, comprising:

(a) a top wall, (b) an annular sidewall downwardly depending from the top wall, (c) a primary closure thread carried on the inside surface of the annular sidewall for cooperation with the container neck thread, said primary closure thread being divided into a plurality of primary thread segments by one or more venting grooves, (d) at least one venting groove in the sidewall traversing the closure thread, said venting groove dividing the primary closure thread so as to form the primary thread segments, (e) a reinforcing secondary thread within said venting groove and extending across said venting groove connecting the primary thread segments of the primary closure thread, said secondary thread having a smaller height than the primary thread segments, the lower edge portion of said secondary thread being aligned with the lower edge portion of each adjacent primary thread segment and at least the median edge portion of said secondary thread being offset from the corresponding portion of said primary thread segment, and (f) a sealing system above the closure thread for effecting a gas-tight seal between the closure and the container.

2. The thermoplastic closure of claim 1 wherein the ends of said primary thread segments are rounded.

3. The thermoplastic closure of claim 1 wherein said closure is made of polypropylene.

4. The thermoplastic closure of claim 1 wherein said closure is made of polyethylene.

5. The thermoplastic closure of claim 1 wherein said closure is made of high density polyethylene.

6. The thermoplastic closure of claim 1 wherein said closure is made of nylon.

7. The thermoplastic closure of claim 1 wherein said closure is made of molded thermoplastic.

8. The thermoplastic closure of claim 1 wherein the number of said venting grooves in said sidewall and the depth of said grooves in said sidewall is such that sufficient venting groove cross-section area is provided for venting the pressurized gas at a rate so that conventional removal of said closure from said threaded neck will occur only after the venting is substantially accomplished.

9. The thermoplastic closure of claim 8 wherein said venting groove has a width of about 1/16 inch, a depth of from about 0.005 inch to about 0.015 inch, and said sidewall has a thickness of from about 0.035 inch to about 0.055 inch.

10. The thermoplastic closure of claim 8 wherein said venting groove has a width of about 1/16 inch, a depth of from about 0.005 inch to about 0.015 inch, and said sidewall has a thickness of from about 0.035 inch to about 0.045 inch.

11. The thermoplastic closure of claim 1 further characterized in that there are a plurality of said venting grooves in said sidewall, each such groove containing at least one of said secondary threads, in that the ends of said primary thread segments are rounded, and in that the number of said venting grooves in said sidewall and the depth of said grooves in said sidewall is such that sufficient venting groove cross-section area is provided for venting the pressurized gas at a rate so that conventional removal of said closure from said threaded neck will occur only after the venting is substantially accomplished.

12. The thermoplastic closure of claim 11 wherein said venting groove has a width of about 1/16 inch, a depth of from about 0.005 inch to about 0.015 inch, and said sidewall has a thickness of from about 0.035 inch to about 0.055 inch.

13. The thermoplastic closure of claim 11 wherein said venting groove has a width of about 1/16 inch, a depth of from about 0.005 inch to about 0.015 inch, and said sidewall has a thickness of from about 0.035 inch to about 0.045 inch.

14. The thermoplastic closure of claim 11 still further characterized in that the median and upper edge portions of each said secondary thread are offset from the corresponding portions of said primary thread segments.

15. The thermoplastic closure of claim 11 wherein said closure is made of polyethylene or polypropylene and wherein said venting groove has a width of about 1/16 inch, a depth of from about 0.005 inch to about 0.015 inch, and said sidewall has a thickness of from about 0.035 inch to about 0.055 inch.

* * * * *